US009527611B2

(12) United States Patent
Lofman et al.

(10) Patent No.: US 9,527,611 B2
(45) Date of Patent: Dec. 27, 2016

(54) ARRANGEMENT FOR MANUFACTURING OF PORTION PACKETS

(75) Inventors: Lars-Olof Lofman, Ytterby (SE); Thom Aspgren, Hisings Backa (SE); Dennis Eriksson, Olofstorp (SE); Tomas Larsson, Kungsbacka (SE)

(73) Assignee: Swedish Match North Europe AB, Stockholm (SE)

( * ) Notice: Subject to any disclaimer, the term of this patent is extended or adjusted under 35 U.S.C. 154(b) by 736 days.

(21) Appl. No.: 13/884,744

(22) PCT Filed: Nov. 23, 2011

(86) PCT No.: PCT/EP2011/070739

§ 371 (c)(1),
(2), (4) Date: May 10, 2013

(87) PCT Pub. No.: WO2012/069505

PCT Pub. Date: May 31, 2012

(65) Prior Publication Data

US 2013/0239517 A1 Sep. 19, 2013

Related U.S. Application Data

(60) Provisional application No. 61/417,314, filed on Nov. 26, 2010.

(30) Foreign Application Priority Data

Nov. 26, 2010 (EP) ..... 10192764

(51) Int. Cl.
*B65B 1/00* (2006.01)
*B65B 1/04* (2006.01)
(Continued)

(52) U.S. Cl.
CPC . *B65B 1/04* (2013.01); *B65B 5/06* (2013.01); *B65B 29/00* (2013.01); *B65B 35/28* (2013.01); *B65B 35/40* (2013.01); *B65B 29/02* (2013.01)

(58) Field of Classification Search
CPC ..... B65B 1/04; B65B 1/06; B65B 1/10; B65B 1/16; B65B 35/40; B65B 29/00
(Continued)

(56) References Cited

U.S. PATENT DOCUMENTS 3,826,062 A 7/1974 Lewis et al.
3,951,399 A 4/1976 Reist
(Continued)

FOREIGN PATENT DOCUMENTS

DE 21 60 249 A1 5/1973
EP 0 138 649 A2 4/1985
(Continued)

OTHER PUBLICATIONS

European Search Report, dated Apr. 15, 2011, from corresponding European application.
(Continued)

*Primary Examiner* — Andrew M Tecco
*Assistant Examiner* — Chelsea Stinson
(74) *Attorney, Agent, or Firm* — Knobbe Martens Olson & Bear LLP

(57) ABSTRACT

An arrangement for manufacturing of portion packets of a product for oral use, includes a forming arrangement configured to form portion packets of a bulk material. The arrangement includes a device for placing the portion packets into a container, wherein the device includes a portion packet transporting unit and a portion packet positioning unit. The transporting unit is configured to transport individual portion packets to the positioning unit, and the positioning unit is configured to position the portion packets in a certain pattern during operation of the device. The transporting unit includes a product channel for transporting
(Continued)

the portion packets, the product channel having an inlet and an outlet, the transporting unit further including a gas channel for connection to a source of pressurized gas, the gas channel arranged to, when connected to the source, guide pressurized gas into the product channel in a direction towards the product channel outlet.

20 Claims, 11 Drawing Sheets

(51) Int. Cl.

| | |
|---|---|
| ***B65B 5/06*** | (2006.01) |
| ***B65B 35/28*** | (2006.01) |
| ***B65B 35/40*** | (2006.01) |
| ***B65B 29/00*** | (2006.01) |
| *B65B 29/02* | (2006.01) |

(58) Field of Classification Search
USPC ..... 53/531, 544
See application file for complete search history.

(56) References Cited

U.S. PATENT DOCUMENTS

| | | | | |
|---|---|---|---|---|
| 4,703,765 | A * | 11/1987 | Paules | B65B 1/36 131/112 |
| 4,768,642 | A * | 9/1988 | Hunter | B65G 47/082 198/419.2 |
| 5,127,209 | A * | 7/1992 | Hunter | B65B 35/44 198/419.3 |
| 5,174,088 | A | 12/1992 | Focke et al. | |
| 5,678,395 | A * | 10/1997 | Black, Jr. | B65B 27/02 53/542 |
| 6,135,120 | A | 10/2000 | Lofman et al. | |
| 6,823,981 | B2 * | 11/2004 | Ogle | B65B 5/08 198/417 |
| 6,925,784 | B2 * | 8/2005 | Escobar | B65B 5/08 414/793.7 |
| 7,681,374 | B2 * | 3/2010 | Schulte | B65B 35/58 198/374 |
| 8,549,825 | B2 * | 10/2013 | Takayama | B65B 5/061 198/418.9 |
| 2008/0245810 | A1 * | 10/2008 | Karwacki, Jr. | B08B 5/00 221/13 |
| 2009/0193757 | A1 * | 8/2009 | Roesler | B31B 19/90 53/138.1 |
| 2009/0193762 | A1 * | 8/2009 | Thierig | B31B 23/00 53/455 |
| 2009/0272758 | A1 * | 11/2009 | Karwacki, Jr. | B65B 1/16 221/278 |
| 2010/0071318 | A1 * | 3/2010 | Brandhorst | B65B 35/54 53/446 |
| 2010/0205913 | A1 * | 8/2010 | Iwasa | B65B 35/44 53/531 |
| 2012/0000164 | A1 * | 1/2012 | Boldrini | B65B 1/24 53/444 |
| 2013/0232922 | A1 * | 9/2013 | Aspgren | B65B 5/06 53/473 |

FOREIGN PATENT DOCUMENTS

| | | | |
|---|---|---|---|
| EP | 0 149 985 | A1 | 7/1985 |
| GB | 672 939 | | 5/1952 |
| JP | 59-74817 | | 4/1984 |
| JP | 4-228056 | | 8/1992 |
| JP | 09142654 | | 3/1997 |
| JP | 2006-124032 | | 5/2006 |
| JP | 2010 516565 | | 5/2010 |
| SE | 506146 | C2 | 11/1997 |
| WO | 96/22223 | A1 | 7/1996 |
| WO | WO 96/22223 | | 7/1996 |
| WO | WO 2008/090071 | | 7/2008 |
| WO | 2009/025604 | A1 | 2/2009 |
| WO | 2009/047627 | A1 | 4/2009 |
| WO | 2010/106944 | A1 | 9/2010 |
| WO | WO 2010-106944 | | 9/2010 |

OTHER PUBLICATIONS

International Search Report, dated May 15, 2012, from corresponding PCT application.
International Search Report for International Application No. PCT/EP2011/070738 dated Mar. 14, 2012.

* cited by examiner

ARRANGEMENT FOR MANUFACTURING OF PORTION PACKETS

TECHNICAL FIELD

This invention relates to an arrangement for manufacturing of portion packets of a product for oral use, which arrangement comprises a device for placing the portion packets into a container.

BACKGROUND OF THE INVENTION

Manufacturing of portion packets of a smokeless product for oral use, such as pouches filled with tobacco snuff or non-tobacco snuff, generally involve the steps of (pre) treating and processing of the raw material (e.g. grounding, adding salt and water, pasteurizing, mixing with additives, moistening, etc.), forming portion-sized packets of the bulk material, wrapping a packaging material, such as a standard cellulose based non-woven fabric for snus, around the portion packets, and placing individual portion packets in a box or container.

Examples of devices used in such manufacturing are disclosed in e.g. WO 2009/025604, EP 138649, EP 149985, WO 2009/047627 and SE 506146.

The step of placing the portion packets in a container has not been paid much attention to in the past. Principally, a certain number of portion packets have simply been allowed to fall down in the container.

However, lately it has been paid some attention to the fact that portion packets positioned in a certain pattern in the container provides a more attractive appearance to the user. It has also been proposed that, by being able of positioning the portion packets in the container, the portion packets might be packed into the container in a more efficient way, both with regard to time (production speed) and space (geometrically efficient packing).

How to achieve efficient positioning/packing of portion packets in large-scale production is, however, not obvious because tobacco snuff or non-tobacco snuff portion pack products are relatively difficult to handle in automated processes (since they usually are soft and somewhat sticky) and because the production rate is very high (typically several hundreds of portion packets per minute).

SUMMARY OF THE INVENTION

An object of this invention is to provide means for placing portion packets of a product for oral use, such as a tobacco snuff or a non-tobacco snuff product, into a container, which device enables positioning of the portion packets in the container. This object is achieved by the arrangement defined by the technical features contained in independent claim 1. The dependent claims contain advantageous embodiments, further developments and variants of the invention.

The invention concerns an arrangement for manufacturing of portion packets of a product for oral use, said arrangement comprising a forming arrangement configured to form portion packets of a bulk material.

The inventive arrangement is characterized in that it comprises a device for placing the portion packets into a container, wherein the device comprises a portion packet transporting unit and a portion packet positioning unit, wherein the transporting unit is configured to transport individual portion packets to the positioning unit and wherein the positioning unit is configured to position the portion packets in a certain pattern during operation of the device, wherein the transporting unit comprises a product channel intended for transportation of the portion packets, said product channel having an inlet and an outlet, wherein the transporting unit further comprises a gas channel intended to be connected to a source of pressurized gas, wherein the gas channel is arranged to, when connected to said source, guide pressurized gas into the product channel in a direction towards the product channel outlet, and wherein the gas channel has an outlet opening positioned in the product channel at a distance from the product channel inlet such that an under-pressure is created at the product channel inlet when pressurized gas is fed through said gas channel.

By creating an under-pressure (i.e. a pressure below that of the atmosphere) at the inlet of the product channel a suction force is created that sucks the portion packet into the product channel in a downstream direction towards the point where the gas channel outlet opening is positioned at which point the portion packet is further forced by the pressurized gas downstream through the product channel towards the product channel outlet.

Due to this suction capability, portion packets can be transported in a controlled and efficient way from various portion packet feeding arrangements located before, or upstream of, the transporting unit in the production line. By varying the pressure of the pressurized gas, the under-pressure, i.e. the suction force, at the product channel inlet can be varied in a controllable manner and thereby be adapted to different conditions (e.g. different portion packet properties).

Moreover, by varying the pressure of the pressurized gas it is possible to, in a controllable manner, vary the speed of the portion packet at the point where it leaves the product channel outlet. This way the transporting unit of the invention can be adapted to various types of portion packet positioning units, or to the particular condition of a certain positioning unit.

In most situations a transporting unit of the inventive type will significantly increase the speed of the portion packet compared to the speed in the feeding arrangement upstream of the transporting unit. Such an increase in speed means that the distance between the individual portion packets will increase. This makes in turn the job easier for the positioning unit since it may occupy more space during the time interval between two incoming portion packets (compared to the situation where the speed has not been increased and where, accordingly, the distance between a rear part of a first portion packet and a front part of a second, following, portion packet is shorter). And if the job is easier for the positioning unit it becomes easier to come up with a design that works properly.

Using only compressed gas (over-pressure) for transporting the portion packets, e.g. by discharging pressurized air at the product channel inlet, gives rise to a complicated flow pattern that in turn makes it much more difficult to control the transport of the portion packets, both with regard to the timing and the speed of the transport. Besides that the inventive concept provides for a more controllable transport than the use of over-pressure only, it is also less energy-intensive since the losses are smaller. Further, the transporting does not rely on moving parts, such as conveyor belts, which makes it more reliable.

A controlled transport of the portion packets is of paramount importance for allowing the positioning unit to work properly, irrespectively of the exact design of the positioning unit. Even small variations in timing or speed in the transport of the portion packets are likely to lead to clogging and thereby interruptions in the production process.

In an embodiment of the invention the gas channel is arranged such that, when pressurized gas is discharged from the gas channel outlet opening into the product channel, the gas exhibits an initial direction of flow that forms an angle a that is less than 30°, preferably less than 15°, in relation to a longitudinal direction of the product channel.

In an embodiment of the invention the gas channel outlet opening is positioned at a distance also from the product channel outlet and that the product channel is substantially straight between the position of the gas channel outlet opening and the product channel outlet.

In an embodiment of the invention the product channel has a width and height that is 1-15% larger than a width and thickness of the portion packet to be transported.

In an embodiment of the invention the ratio between the area of the gas channel outlet opening 17 and the cross-sectional area of the product channel 12 is in the interval of 0.02-0.2, preferably in the interval of 0.05-0.15.

In an embodiment of the invention the positioning unit comprises a set of portion packet receiving compartments arranged in a certain pattern, each of said compartments having an entrance end allowing a portion packet to enter the compartment and, at an opposite side of the compartment, a retaining end preventing a portion packet from exiting the compartment in that direction, wherein the positioning unit further comprises a discharging member configured to discharge portion packets from the compartments to the container, wherein the compartments are associated with a supporting structure that retains the compartment pattern during operation of the device.

In such a device the portion packets can be fed in various ways to the compartments where they will remain until the discharging member is used to transfer the portion packets into the container. Since the compartments are arranged in a certain pattern, e.g. circumferentially distributed in a circular manner, also the portion packets will be arranged in a corresponding pattern when positioned in the compartments. Due to fixing and retaining properties of the supporting structure, that fixes the shape of the compartments and retains the pattern during operation of the device, the portion packet pattern is retained also when discharging the portion packets from the compartments into the container. The same pattern can be retained for the portion packets when transferred to the container, for instance by adapting the size and shape of the container to that of the initial portion packet pattern and by handling the container properly after it has been filled.

Thus, instead of organizing the portion packets during the step of placing them into the container or when they actually have been placed in the container, the portion packets are positioned in a certain pattern already when they have entered the compartments, i.e. before the step of transferring them into the container. Such a process is suitable for automation and a high production rate because it is more reliable and creates a period of time suitable for positioning of the next container to be filled.

This embodiment of the invention makes use of a supporting structure that keeps the compartments in a fixed position in relation to each other so as to retain the pattern during operation of the device. This way it is possible to reduce the number of moving parts compared to, for instance, solutions involving one or several conveyor belts, which can be used to improve the reliability of the device. A further advantage of the present invention is that the compartments do not narrow before discharge as is normally the case for, for instance, conveyor belt-solutions where products are retained between separating walls fastened to the belt. Typically, the products are loaded when the belt turns around a pulley—which causes the walls to separate from each other—and unloaded at a straight part of the conveyor belt—where the walls are parallel. Such a narrowing can lead to clamping of the product and make discharge problematic.

In an embodiment of the invention each of said compartments comprises a first and a second wall member arranged at an angle in relation to each other such as to form a wedge-shaped structure, wherein the wider end of the wedge-shaped structure forms the compartment entrance end.

In an embodiment of the invention the transporting unit and the portion packet receiving compartments are movable in relation to each other such that the entrance end of each of the compartments can be directed towards the transporting unit.

In an embodiment of the invention the compartments are arranged side-by-side such that a single wall member forms a dividing wall between two adjacent compartments.

In an embodiment of the invention the supporting structure is moveably suspended in the positioning unit such that the entrance ends of the compartments can be positioned in different directions and/or positions by moving the supporting structure. By controlling this movement the compartments can be filled with portion packets fed to the portion packet positioning unit, for instance by controlling the movement in a stepwise manner and loading portion packets one by one. Preferably, the supporting structure is rotationally and/or transversally suspended in the positioning unit such that the direction/position of an entrance end of a compartment can be varied by rotating and/or transversally moving the supporting structure. The term "transversally" refers to the transport direction in which portion packets are fed to the positioning unit. Thus, the transversal direction is typically perpendicular to the transport direction.

In an embodiment of the invention the discharge member comprises an ejector element that has a shape that corresponds with the pattern of compartments such that the ejector element, when activated, is capable of ejecting portion packets present in each of the compartments.

In an embodiment of the invention the discharge member is configured to discharge portion packets from each of the compartments in a direction that is substantially perpendicular to a direction corresponding to a straight line connecting the entrance and retaining ends of the compartment, i.e.

sideways in a direction perpendicular to the direction in which the portion packets have entered the compartment.

The invention also refers to an arrangement for manufacturing of portion packets of a product for oral use, which arrangement comprises a device of the above type.

In an embodiment of the invention the arrangement comprises a forming arrangement configured to form portion packets of a bulk material.

In an embodiment of the invention the arrangement comprises a packaging arrangement configured to wrap a packaging material around individual portion packets, wherein said packaging arrangement is arranged upstream of the transporting unit so that portion packets fed to the transporting unit are wrapped in said packaging material.

BRIEF DESCRIPTION OF DRAWINGS

In the description of the invention given below reference is made to the following figure, in which.

DESCRIPTION OF EXAMPLE EMBODIMENTS OF THE INVENTION

Figure 1:
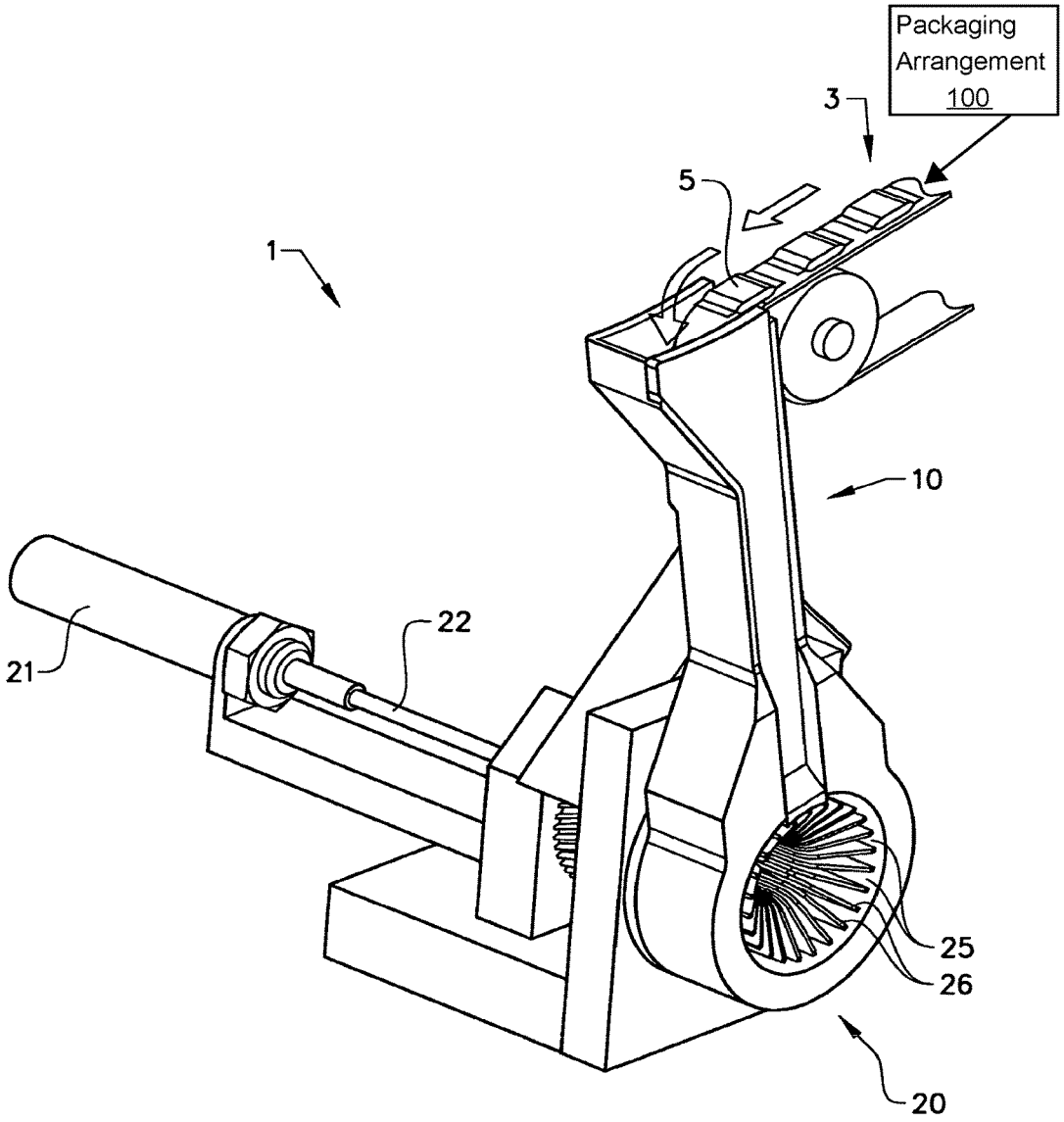
FIG. 1 shows a first embodiment of the inventive device.

FIG. 1 shows a first embodiment of the inventive device 1 for placing portion packets 5 of a product for oral use into a container 7. In this case the portion packets are pouches filled with tobacco snus or non-tobacco snus.

As can be seen in FIG. 1, the device 1 comprises a portion packet feeding arrangement 3, a portion packet transporting unit 10 and a portion packet positioning unit 20, wherein the feeding arrangement 3 is configured to feed portion packets 5 to the transporting unit 10, wherein the transporting unit 10 is configured to transport individual portion packets 5 to the positioning unit 20 and wherein the positioning unit 20 is configured to position the portion packets 5 in a certain pattern during operation of the device 1.

In this example the transporting unit 10 and the positioning unit 20 are arranged in such a way as to form what can be regarded as one integrated unit.

The transporting unit 10 is further described below in relation to FIGS. 3 and 5. The positioning unit 20 is further described below in relation to FIGS. 3-5. A design of an alternative positioning unit 200 is shown in FIGS. 6-9.

As shown in FIG. 1, the positioning unit 20 comprises, for instance, a set of portion packet receiving compartments 25 arranged side-by-side in a circular pattern, wherein said compartments 25 in this case are formed by wall members 26 arranged at an angle in relation to each other such as to form a wedge-shaped compartment 25 between each pair of wall members 26. The positioning unit 20 further comprises a discharging member of which a cylinder 21 and an ejection pin 22 are shown in FIG. 1.

The device 1 shown in FIG. 1 forms part of an arrangement for manufacturing of portion packets 5 of a product for oral use. In addition to what is shown in FIG. 1, this manufacturing arrangement comprises a processing arrangement configured to process a bulk material, which in this example is based on a tobacco or non-tobacco material. The manufacturing arrangement further comprises a forming arrangement configured to form the portion packets 5 of the bulk material. Further, the manufacturing arrangement comprises a packaging arrangement 100 configured to wrap a packaging material around individual portion packets such as to form pouches. The packaging arrangement 100 is arranged upstream of the transporting unit 10 and of the feeding arrangement 3 so that portion packets 5 fed to the transporting unit 10 are wrapped in said packaging material.

Manufacturing processes of smokeless tobacco products for oral use, e.g. moist snuff such as snus, and chewing tobacco, are well known to the person skilled in the art, and any known process thereof may be used. Moist snuff is known as either Swedish-type snus or American-type moist snuff.

A general description of snus manufacturing is presented by e.g. ESTOC, European Smokeless Tobacco Council, and the GothiaTek quality standard for snus. Methods for the manufacture of American type moist snuff and chewing tobacco are described in e.g. Wahlberg, I., Ringberger, T. (1999) Smokeless Tobacco. In: *Tobacco: Production, Chemistry and Technology,* (eds D. L. Davis & M. T. Nielsen) pp. 452-460. World Agriculture Series, Blackwell Science Ltd. Tobacco is the raw material in any oral smokeless tobacco product. However, for the reason of controlling the nicotine content of the products, the raw material may well be constituted of a mixture of tobacco and other plant materials.

The principle of snus manufacturing is to mix ground or cut tobacco with water and sodium chloride and heat treating the mixture for a period of time long enough (typically several hours), and at a temperature high enough, to meet the demands for pasteurization. The heat treatment also gives texture and color to the mixture and enhances the natural tobacco flavors. After heat treatment the mixture is chilled. Additives such as pH-regulators and flavourings are then added and the mixture may be adjusted in moisture content.

American-type moist snuff is commonly produced through a fermentation process of moisturized ground or cut tobacco. Flavors and ingredients are mixed to the blend and water is added to adjust the moisture content.

Chewing tobacco is most often made of loose leaf tobacco, which is cured at a slightly elevated temperature. The tobacco leaves are then threshed into flakes and the mid-rids (stems) are removed. The tobacco fragments thus obtained are usually treated with a solution of flavors and additives, dried to lower the moisture content and packed in a consumer package. The product achieved is known as "loose-leaf chewing tobacco".

Hard snuff is a group of oral tobacco-based products intended for oral use as a delivery system of nicotine from tobacco. Besides the additive carrying the active substance, which is tobacco carrying nicotine, hard snuff products are generally constituted by entirely or substantially inert materials such as fibres and polymers. They may also be mainly constituted by powdered tobacco.

Dry oral snuff resembles snus and American-type moist snuff but is characterized by being made of a finely ground tobacco powder and having a low moisture content (typically less than 10%). The product may be heat treated but is normally manufactured from fire-cured fermented tobacco which is ground into a powder to which other ingredients such as flavors are added.

Manufacturing of oral smokeless non-tobacco snuff products typically follows the procedure of manufacturing of oral smokeless tobacco products, with the obvious difference that tobacco is replaced by non tobacco raw material, typically constituted of non-tobacco plant materials. Any known type of oral smokeless tobacco or oral non-tobacco product may be used as a bulk material in the portion packets.

The principal structure and function of the feeding, processing, forming and packaging arrangements are well known to a person skilled in the art. These arrangements may be arranged in different ways and are not further described here.

Figure 2:
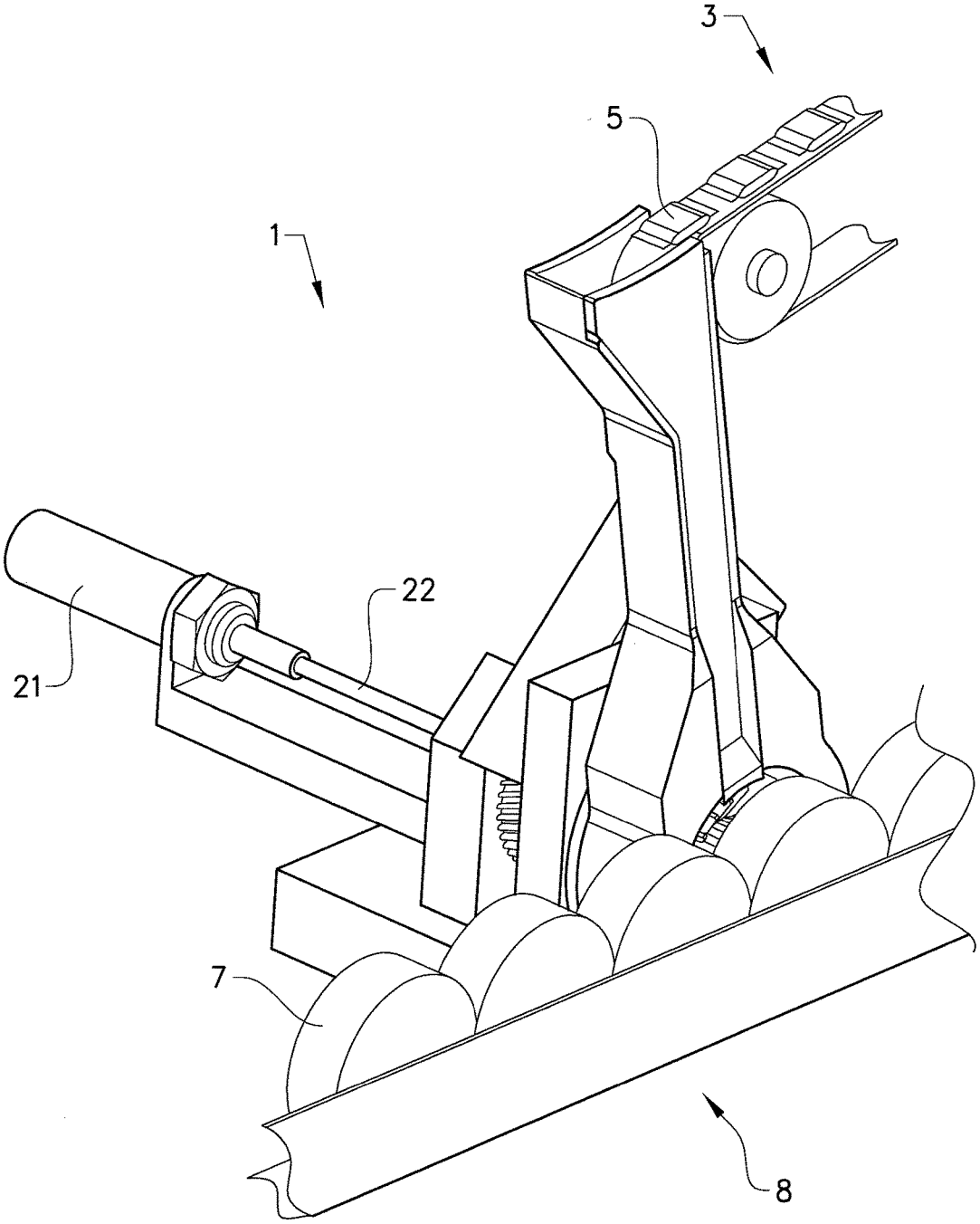
FIG. 2 shows a similar view as FIG. 1 but with containers added.
Figure 10:
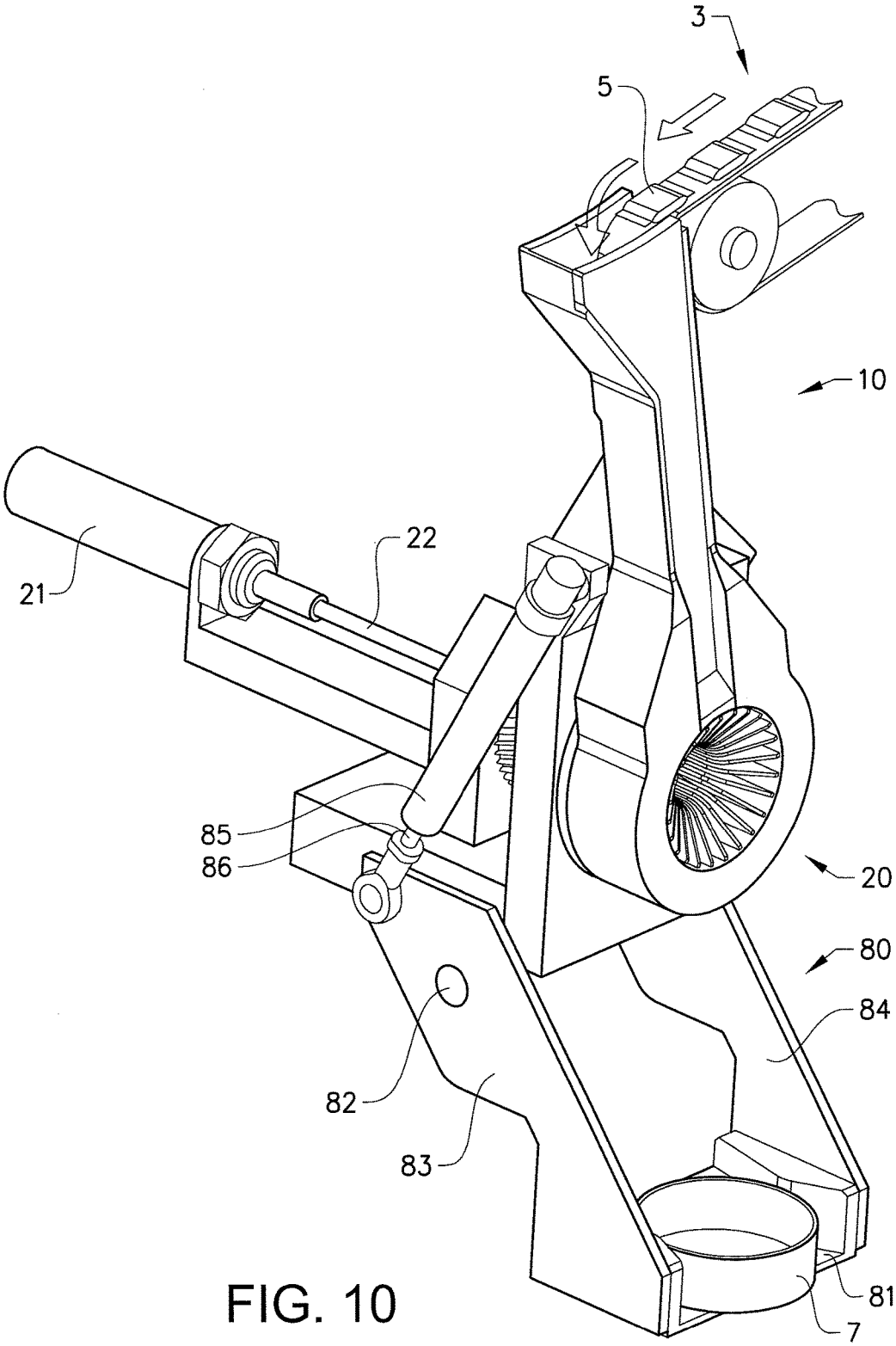
FIG. 10 shows, in a first position, a preferred embodiment of a container holding arrangement of the inventive device.
Figure 11:
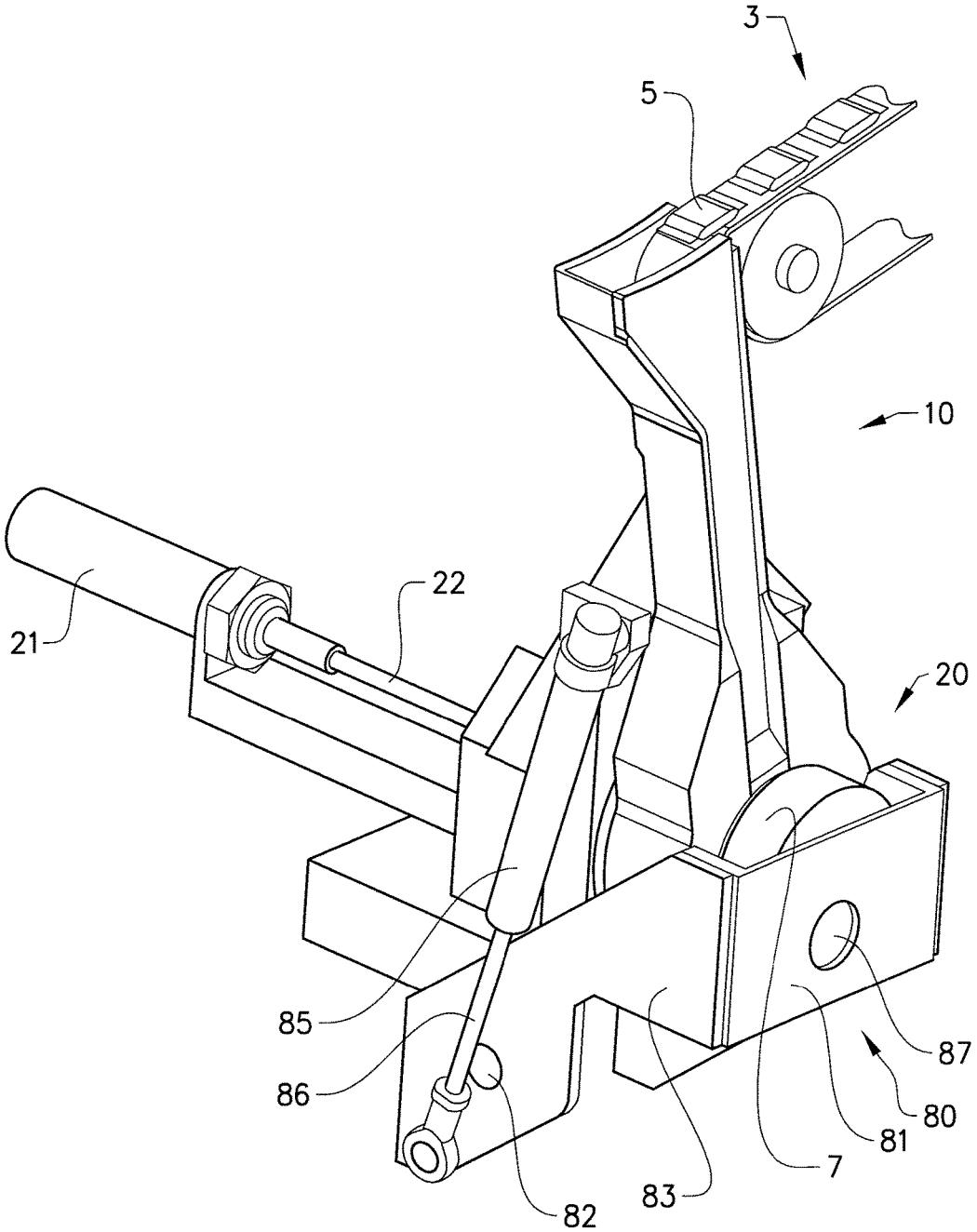
FIG. 11 shows the container holding arrangement of FIG. 10 in a second position.

FIG. 2 shows a similar view as FIG. 1, but FIG. 2 also shows containers 7 and a container holding arrangement 8. This arrangement 8 is configured to hold the container 7 in a certain position in relation to the positioning unit 20 such as to allow portion packets 5 placed in the compartments 25 to be discharged into the container 7. The container holding arrangement 8 controls the movement of the containers 7 in relation to the compartments 25 such as to allow positioning of each of the containers 7, one by one, in connection to the compartments 25. An open end of the containers 7 is facing towards the compartments 25. In FIG. 2 the container holding arrangement 8 is only depicted schematically. A person skilled in the art is aware of that the container holding arrangement 8 can be arranged in different ways. A preferred embodiment of the container holding arrangement is shown in FIGS. 10-11.

Figure 3:
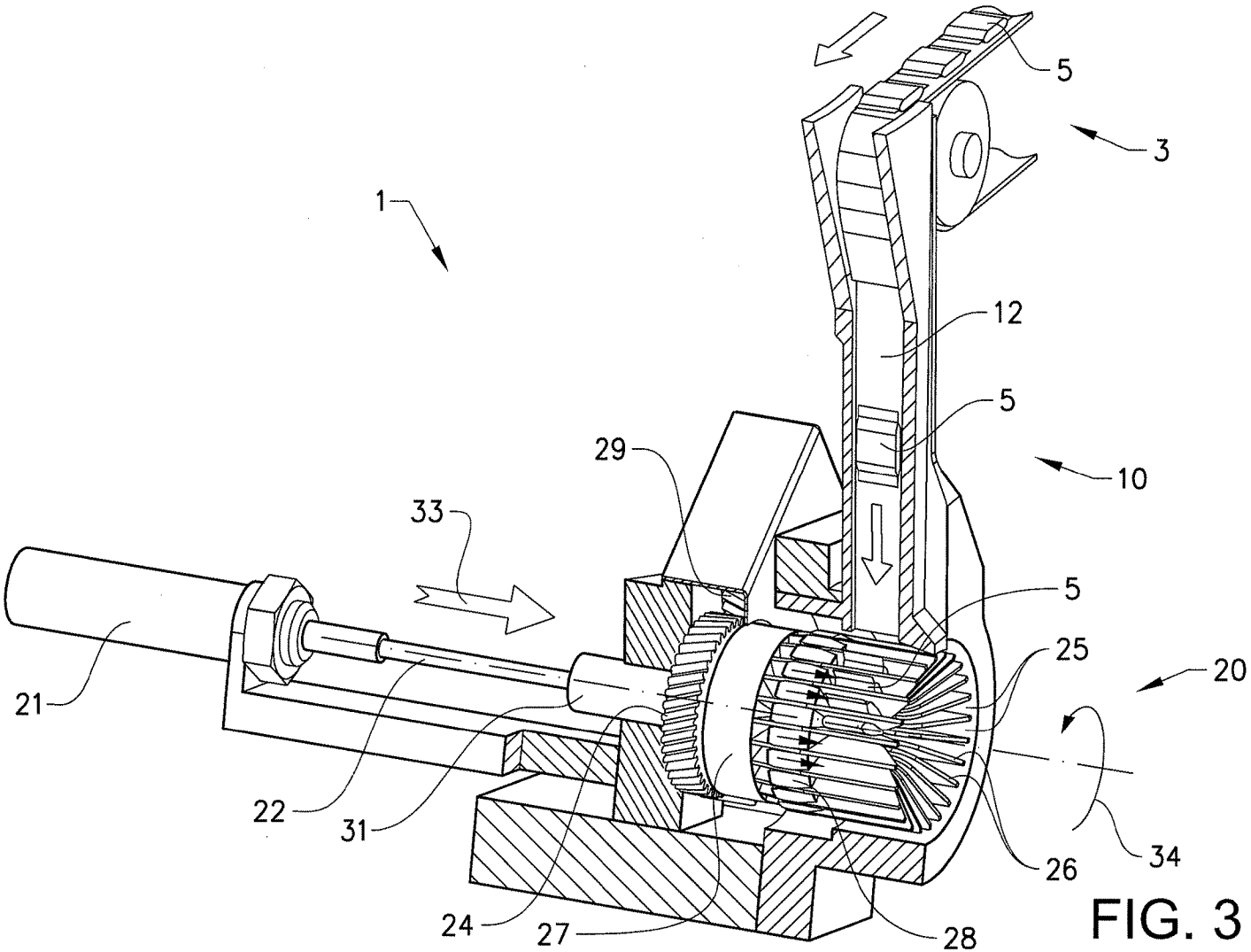
FIG. 3 shows, in a partly sectional view, the embodiment according to FIG. 1.

FIG. 3 shows, in a partly sectional view, the embodiment according to FIG. 1. FIG. 3 shows the device 1 during operation where a portion packet 5 fed to the transporting unit 10 is transported in a controlled way via a product channel 12 to an empty portion packet receiving compartment 25 in the positioning unit 20. Some portion packets 5 have already been positioned in the positioning unit 20, i.e. some of the compartments 25 already contain a portion packet 5. Further portion packets 5 are positioned in the feeding arrangement 3 on their way towards the transporting unit 10.

Figure 5:
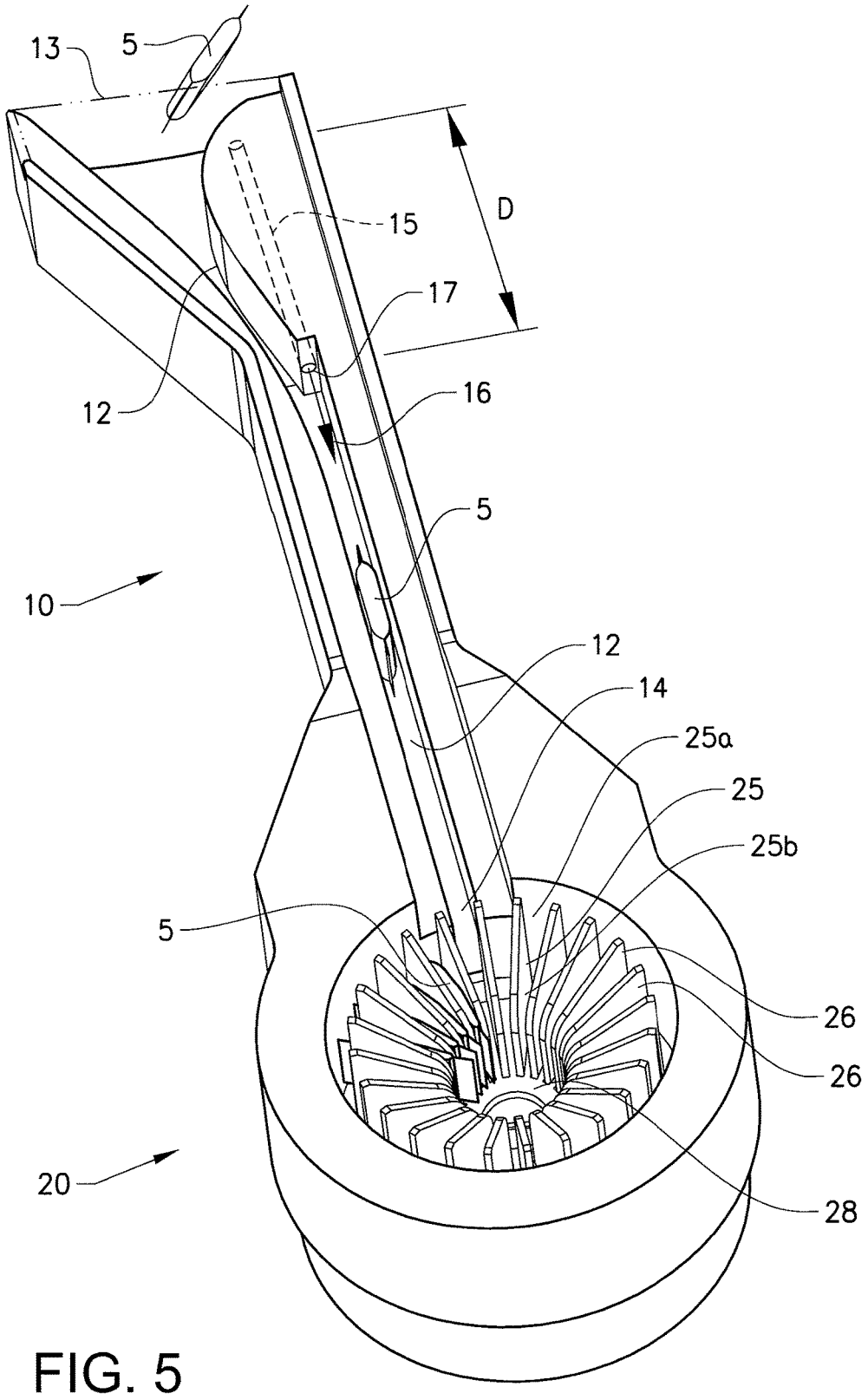
FIG. 5 shows, in a partly sectional view, parts of the embodiment according to FIG. 1.
Figure 6A:
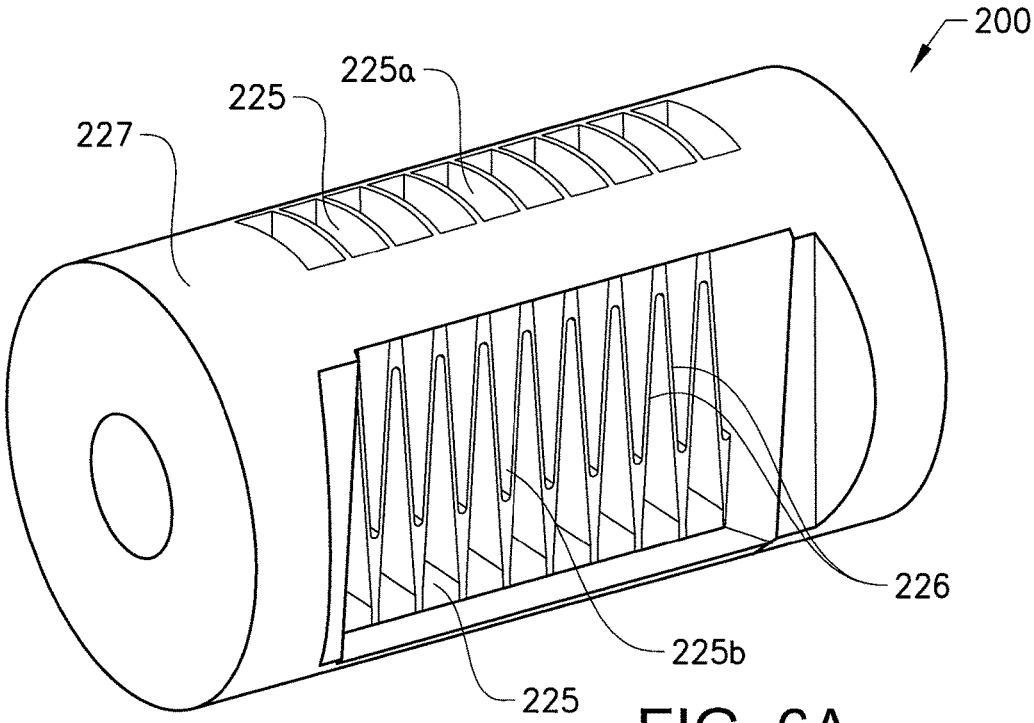
FIG. 6A shows a variant of the positioning unit of the inventive device.
Figure 6B:
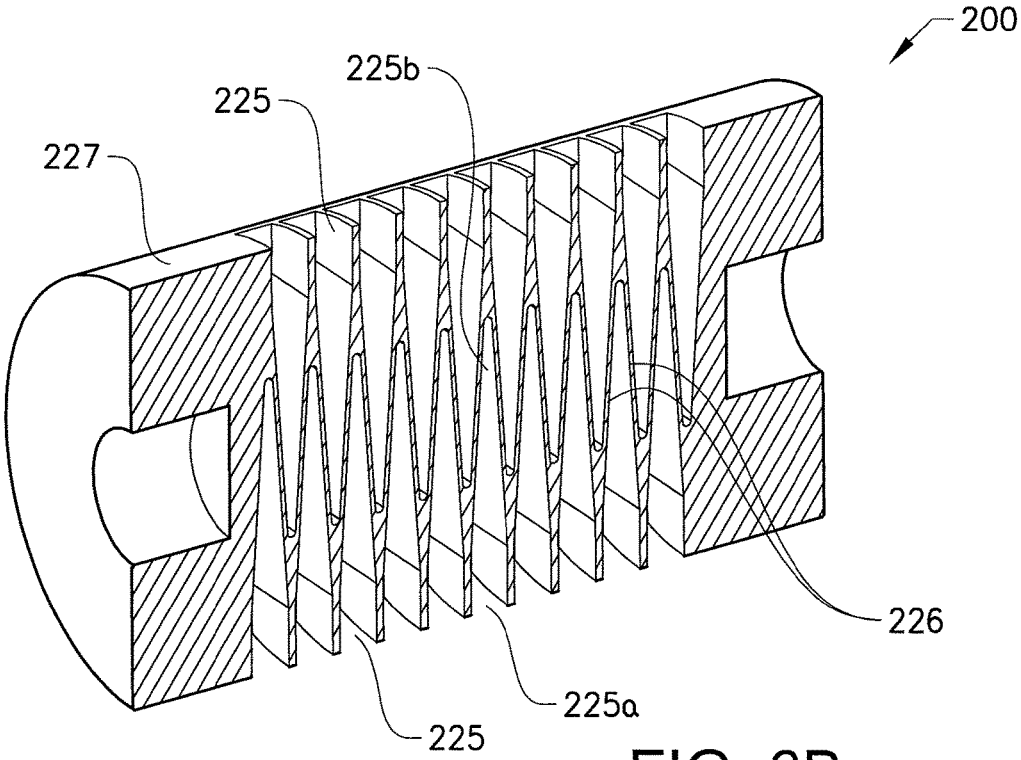
FIG. 6B shows a sectional view of FIG. 6A.

Each of the receiving compartments 25 has an entrance end 25*a* allowing a portion packet 5 to enter the compartment 25 and, at an opposite side, a retaining end 25*b* preventing the portion packet 5 from exiting the compartment 25 in that direction (see also FIG. 5). Each compartment 25 is formed by first and second wall members 26 arranged at an angle in relation to each other such as to form a wedge-shaped structure, wherein the wider end of the wedge-shaped structure forms the compartment entrance end 25*a*. In this case the compartments 25 are distributed side-by-side in a circular pattern with their entrance ends 25*a* directed outwards from the circle and their retaining ends 25*b* directed inwards towards a centre of the circle. Each wall member 26 extends in a radial and an axial direction of the circular pattern and forms a common wall of two adjacent compartments 25.

The transporting unit 10 and the positioning unit 20 are arranged in relation to each other in such a way that an outlet 14 of the product channel 12 of the transporting unit 10 is directed towards the entrance end 25*a* of the portion packet receiving compartment 25. Further, the product channel 12 has a rectangular cross section adapted to a width and a thickness (height) of the portion packets 5 (wherein the width in this case is greater than the thickness/height, see also below) and the transporting unit 10 and the positioning unit 20 are arranged in relation to each other also in such a way that the width direction of the product channel 12 is substantially parallel with the wall members 26 of a receiving compartment 25 having its entrance end 25*a* directed towards the outlet 14 of the product channel 12.

As seen in FIG. 3 the wall members 26 are attached to a supporting structure 27, which in turn is attached to a rotation controlling member 24 in the form of a first gear wheel. The wall members 26, the supporting structure 27 and the first gear wheel 24 are rotationally suspended by means of a bushing 31. The first gear wheel 24 is operatively connected to a second gear wheel 29 that is connected to a driving motor (not shown). By controlling the motor the rotation of the portion packet receiving compartments 25, in relation to the outlet 14 of the product channel 12, can be controlled. This rotation is indicated with an arrow 34.

Accordingly, the transporting unit 10 and the portion packet receiving compartments 25 are movable in relation to each other such that the entrance end 25*a* of each of the compartments 25 can be moved such as to be directed towards the transporting unit 10. In this example the compartments 25 are attached to the supporting structure 27 that is rotationally suspended in the positioning unit 20 such that the entrance end 25*a* of the compartments 25 can be directed in different directions by rotating the supporting structure 27.

The ejection pin 22 extends through the bushing 31 and is connected to an ejection element 28 that has a shape that corresponds with the pattern of compartments 25 and that is moveable in relation to the compartments 25 in a direction parallel to the wall members 26 and perpendicular to the direction in which the portion packets 5 enter the compartments 25. In other words, in the example shown in FIGS. 1-5 the ejection element 28 is moveable in relation to the compartments 25 in an axial direction of the circular pattern. Thus, the ejection pin 22 is, via the ejection element 28, capable of ejecting each portion packet 5 placed in the compartments 25 in a sideways manner (in relation to the direction in which the portion packet 5 has entered the compartment 25).

The ejection element 28 has in this case a number of parts protruding in a radial direction from a central part. This number corresponds to the number of receiving compartments 25 and each of said radially protruding parts has a shape corresponding to that the corresponding compartment 25.

The other end of the ejection pin 22, i.e. the left end in FIG. 3, is connected to a piston (not shown) in the cylinder 21. The position of the piston can be controlled pneumatically or hydraulically which, as such, is well known to the person skilled in the art. By controlling the piston as to move towards the compartments 25 as indicated by the arrow 33 in FIG. 3, i.e. by activating the discharge member, the ejection pin 22 and the ejection element 28 will move in the same direction resulting in that portion packets 5 present in the compartments 25 will be ejected (and placed in the same pattern in the container 7 if this is properly positioned at the positioning unit 20). An outer side of each compartment 25, i.e. the side facing the container 7, is open as to allow the portion packets 5 to be ejected in that direction.

As described more in detail below, the portion packets 5 are driven by pressurized gas, in this case air, through the product channel 12 towards the positioning unit 20. When the portion packet 5 has left the transporting unit 10 and reaches an empty receiving compartment 25 in the positioning unit 20 it will stop in the compartment 25 when the retaining end 25*b* prevents the portion packet 5 from moving further.

At that point the supporting structure 27 and the associated set of compartments 25 are rotated one step, by activating the driving motor, so that the next compartment 25 becomes directed towards the transporting unit 10. When a next portion packet 5 has passed the transporting unit 10 and has been positioned in the next compartment 25 the set of compartments 25 are rotated one step again. This is then repeated until all compartments 25 contain a portion packet 5, which portion packets 5 are positioned in the circular pattern corresponding to that of the compartments 25.

At that point, a suitably shaped container 7 has been positioned in front of the positioning unit 20 such as to be ready for being filled with portion packets 5 of this pattern. To transfer the portion packs 5 into the container 7 the discharge member is activated. This means that the ejection pin 22 and the ejection element 28 is moved towards the container 7 which forces the portion packs 5 out from compartments 25, via its open side, into the container 7.

The portion packets 5 enter the positioning unit 20 in a first direction and are ejected in a second direction that is substantially perpendicular to the first direction. Thus, the portion packets 5 are ejected with their side first towards the container 7.

Figure 4:
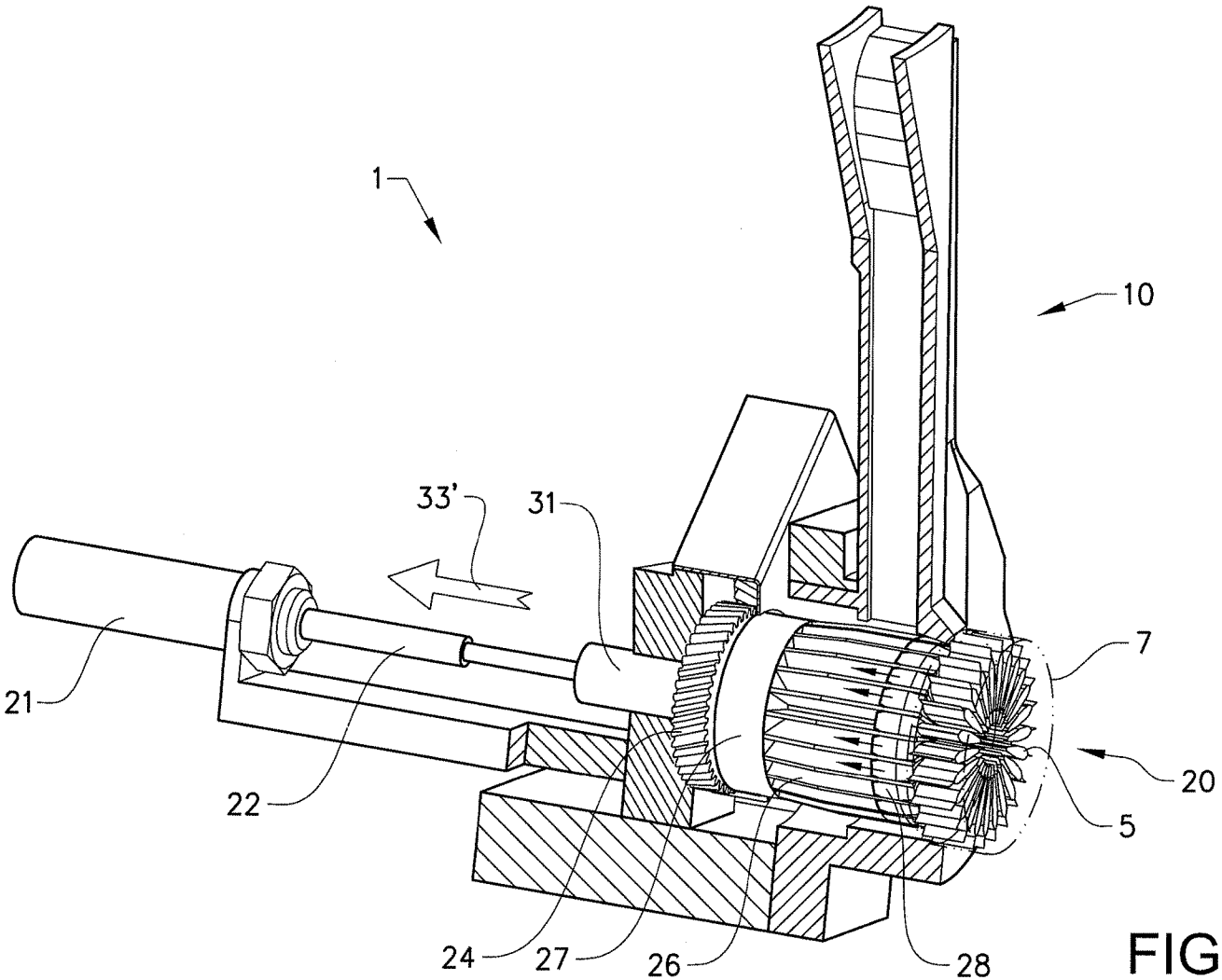
FIG. 4 shows a similar view as FIG. 3 but at another stage of the manufacturing process.

FIG. 4 shows the situation when the discharge member has been activated so that the portion packs 5 have been transferred to the container 7 where they are positioned with their side towards a bottom of the container 7 (which is placed on its edge or side) in the pattern defined by the pattern of the compartments 25. The pattern formed of the compartments 25 has a circular cross section corresponding to that of the container 7 used. During the step of discharging the portion packets 5 into the container 7 feeding of further portion packets 5 to the transporting unit 10 may be interrupted for a certain time interval. An arrow 33' indicates the intended direction of the ejection pin 22 and the ejection element 28 when the discharge member is deactivated so as to continue the process of filling the compartments 25 with further portion packets 5.

FIG. 5 shows, in a partly sectional view, the transporting unit 10 and parts of the positioning unit 20. One portion packet 5 is positioned at an inlet 13 of the product channel 12, another portion packet 5 is positioned in the product channel 12 on its way towards an empty compartment 25, and a few portion packets 5 have already been positioned in their compartments 25. Besides wall members 26 and the entrance and retaining ends 25*a*, 25*b* of the compartments 25, the ejection element 28 can be seen in FIG. 5. It can also be seen that there is an opening in the retaining end 25*b* of the compartments 25. This opening is adapted such as to allow a part of the portion packet 5 to protrude out from the retaining end 25*b* when positioned in the compartment 25. This allows the portion packets 5 to come very close to each other in a central point of the circular pattern (and in the container 7). In addition, the centrally located void these openings give rise to allows the radially protruding parts of the ejection element 28 to be connected in the radial direction to a central part of the ejection element 28 (or directly to the ejection pin 22 if this extends to this position).

In the absence of such a void, i.e. in the case where the wall members 26 meet at a central point of the circular pattern, the protruding parts can be connected directly or indirectly to the ejection pin 22 at a position closer to the bushing 31, e.g. inside the supporting structure 27 (which does not have to be a solid part). In such a case the protruding parts of the ejection element 28 must extend sufficiently in the axial direction of the circular pattern so as to be capable of ejecting the portion packets 5 properly.

As mentioned above the transporting unit 10 comprises a product channel 12 having an inlet 13 and an outlet 14, which product channel 12 is intended for transportation of the portion packets 5. As seen in FIG. 5, the transporting unit 10 further comprises a gas channel 15 intended to be connected to a source (not shown) of pressurized gas, typically air. This gas channel 15 is arranged to, when connected to said source, guide pressurized gas into the product channel in a direction (arrow 16) towards the product channel outlet 14.

The gas channel 15 has an outlet opening 17 positioned in the product channel 12 at a distance D from the product channel inlet 13 such that an under-pressure is created at the product channel inlet 13 when pressurized gas is fed through said gas channel 15. Further, the gas channel 15 is arranged such that, when pressurized gas is discharged from the gas channel outlet opening 17 into the product channel 12, the gas exhibits an initial direction of flow that forms an angle a that is close to zero in relation to a longitudinal direction of the product channel 12. To create a suitable under-pressure, the angle a should be less than 30°, preferably less than 15°.

The distance D may be varied; the gas channel outlet opening 17 may be positioned closer to the product channel outlet 14 than shown in FIG. 5. The important thing is to create an under-pressure at the inlet 13 so that the portion packets 5 are sucked into the product channel 12. Therefore the distance D must not be too short. The minimum value of the distance D depends on the application and is therefore difficult to quantify in general terms. As a guideline the minimum value of the distance D can be set equal to the width of the product channel 12. As a general recommendation the distance D should be at least 2-3 times the minimum value to ensure a favourable flow pattern at the product channel inlet 13.

As mentioned above, use of under-pressure for transporting portion packets 5 to the positioning unit 20 provides for a controlled transport of the portion packets 5, which is of importance for the function of the positioning unit 20. Moreover, it provides for a more energy efficient production process (compared to the alternative of supplying pressurized gas to the inlet 13 for pushing/pressing the portion packet 5 into the product channel 12).

In this example the gas channel outlet opening 17 is positioned at a distance also from the product channel outlet 14 and the product channel 12 is substantially straight between the position of the gas channel outlet opening 17 and the product channel outlet 14.

To enhance the direction of the gas flow, the gas channel outlet opening 17 is arranged substantially in the center of the product channel 12. In order to allow for such a positioning of the outlet opening 17, the product channel 12 exhibits a curved path upstream of the position of the gas channel outlet opening 17.

As an alternative to what is shown in FIG. 5, the product channel 12 can be straight all the way from the inlet 13 to the outlet 13 with gas fed to the product channel 12 at a small angle $\alpha$.

The gas channel 15 can be very short and can in principle consist only of the outlet opening 17.

The length of the product channel 12 can be adapted to the particular application. To have full control of the transportation of the portion packet 5 it is normally an advantage if only one portion packet 5 at a time is present in the product channel 12.

As mentioned above, the product channel 12 has a rectangular cross section adapted to the width and thickness of the portion packets 5 in question. Normally, a suitable width and height of the product channel 12 is 1-15% larger than the width and thickness of the portion packet 5. As an example, the product channel 12 can have a width of 20 mm and a height of 7 mm. Upstream of the gas channel outlet opening 17 the product channel 12 widens towards the inlet 13 to facilitate the entrance of the portion packet 5.

By varying the pressure of the gas fed to the gas channel 15, the under-pressure (i.e. the suction force) at the product channel inlet 13 can be varied in a controllable manner and thereby be adapted to different conditions, e.g. to different properties of the portion packets 5. Moreover, by varying the pressure of the pressurized gas it is possible to, in a controllable manner, vary the speed of the portion packet 5 at the point where it leaves the product channel outlet 14.

It is important to create a sufficient under-pressure at the inlet 13 of the product channel 12 so that the intake and transport of the portion packet 5 can be thoroughly controlled. Generally, the level of under-pressure at the inlet 13 depends on the position of the gas channel outlet opening 17 (both longitudinally and transversely in relation to the product channel 12), the angle a formed between the initial direction of the gas flow and the longitudinal direction of the product channel 12, the ratio between the area of the gas channel outlet opening 17 and the cross-sectional area of the product channel 12, as well as the pressure of the gas fed to the gas channel 15.

As discussed above the longitudinal position of the outlet opening 17 is normally not critical as long as there is a sufficient distance D between the opening 17 and the product channel inlet 13. As to the transversal positioning of the opening 17 it is generally better to have a central location of the opening 17 to obtain a more uniform gas flow. As to the angle $\alpha$: the smaller the angle, the better the under-pressure. An angle $\alpha$of up to around 15° does only slightly deteriorate the under-pressure at the product channel inlet 13. At angles larger than 30° the under-pressure is considerably deteriorated.

As to the area ratio and the gas pressure the relationship is more complicated. The pressure at the product channel inlet 13 plotted as a function of the area ratio forms a U-shaped function. Thus, at a certain optimum value of the area ratio the pressure at the inlet 13 reaches a minimum value (i.e. the under-pressure reaches a maximum value). This function also depends on the pressure of the gas fed to the gas channel 15. When increasing the gas pressure the U-shaped curve becomes steeper and its minimum value moves towards a lower value of the area ratio. For instance, using a gas pressure of 3 bar the optimal value of the area ratio (i.e. the ratio between the area of the gas channel outlet opening 17 and the cross-sectional area of the product channel 12) for reaching the lowest pressure at the product channel inlet 13 is 0.13-0.14.

However, it is not necessary to operate exactly at these optimum points of the pressure curves. Since the U-shaped curves are reasonably flat the under-pressure can be kept at a suitable level even if the gas pressure is varied within reasonable limits and even if the transporting unit 10 is not operated with an optimal area ratio for a given gas pressure. Generally, an area ratio in the interval of 0.02-0.2 is suitable for a gas pressure of 3-6 bar. For gas pressures of 3-4 bar the under-pressure is reasonable even for larger area ratios. An area ratio in the interval of 0.05-0.15 is more suitable for a gas pressure of 3-6 bar. Which area ratio to choose depends on the application (e.g. the required magnitude of the under-pressure and the gas pressure(s) to be used).

FIGS. 6-9 show an alternative positioning unit 200 of the inventive device 1. In similarity to what is described above, portion packet receiving compartments 225, each of which having an entrance end 225*a* and a retaining end 225*b*, are formed by wall members 226 arranged in a wedge-shaped structure, see FIGS. 6A and 6B. Also in this case a single wall member 226 forms a separating wall between two adjacent compartments 225. However, in the variant shown in FIGS. 6-9 the compartments 225 are arranged side-by-side in a first and a second row wherein adjacent compartments 225 have their entrance ends 225*a* facing in opposite directions, i.e. wherein adjacent compartments 225 belong to different rows. The wall members 226 are arranged in a rotatable supporting structure 227.

Figure 7:
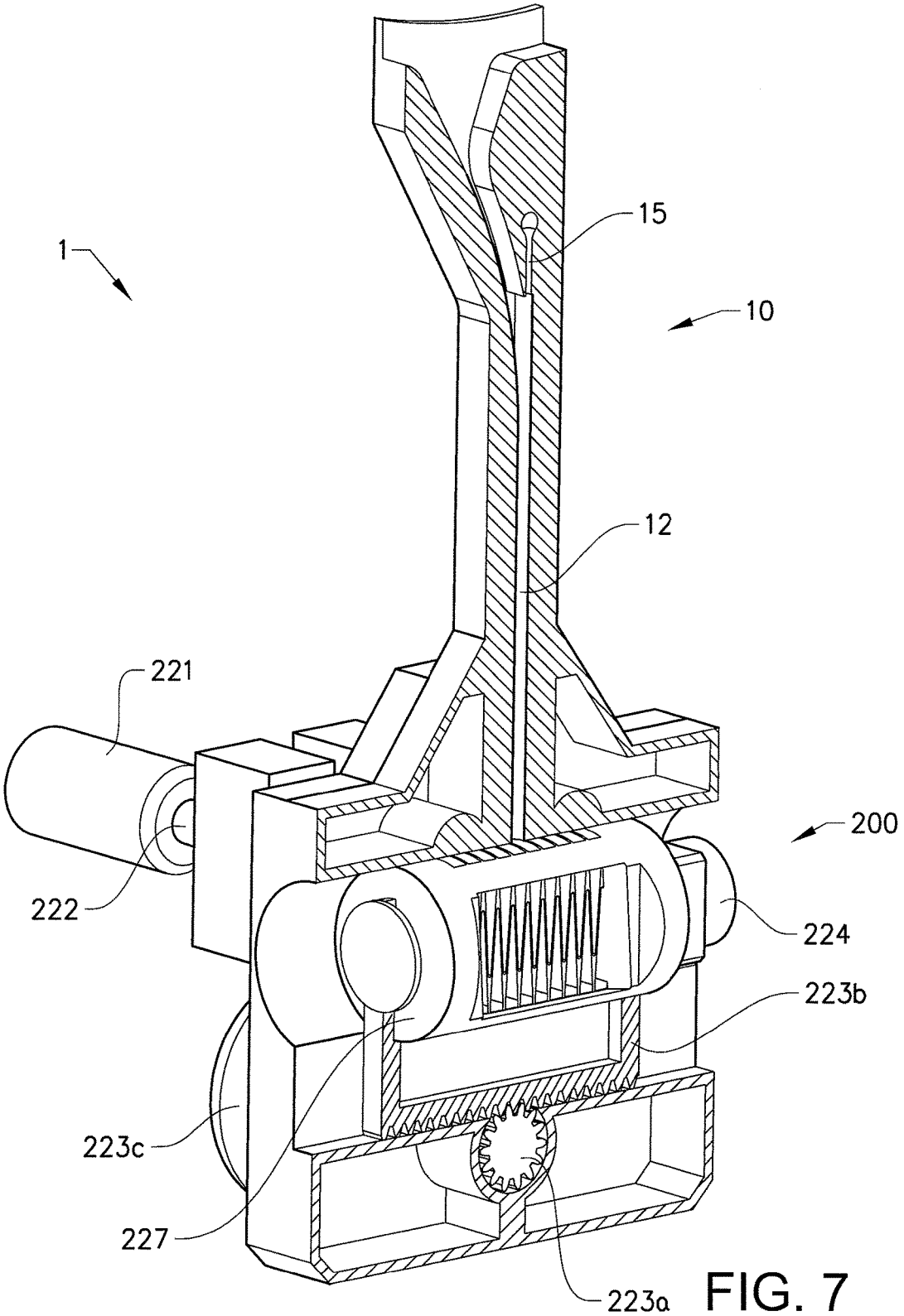
FIG. 7 shows a second embodiment of the inventive device including the variant of FIGS. 6A and 6B.

FIG. 7 shows an inventive device 1 equipped with a positioning unit 200 according to FIG. 6. The transporting unit 10 is similar to what is described above. Also in this case the positioning unit 200 comprises a cylinder 221, an ejection pin 222 (which is connected to a piston located inside the cylinder 221) and a rotation controlling member 224 arranged to control a rotation of the rotationally suspended supporting structure 227. The rotation controlling member 224 comprise a controllable motor and can comprise additional gearings.

Figure 8:
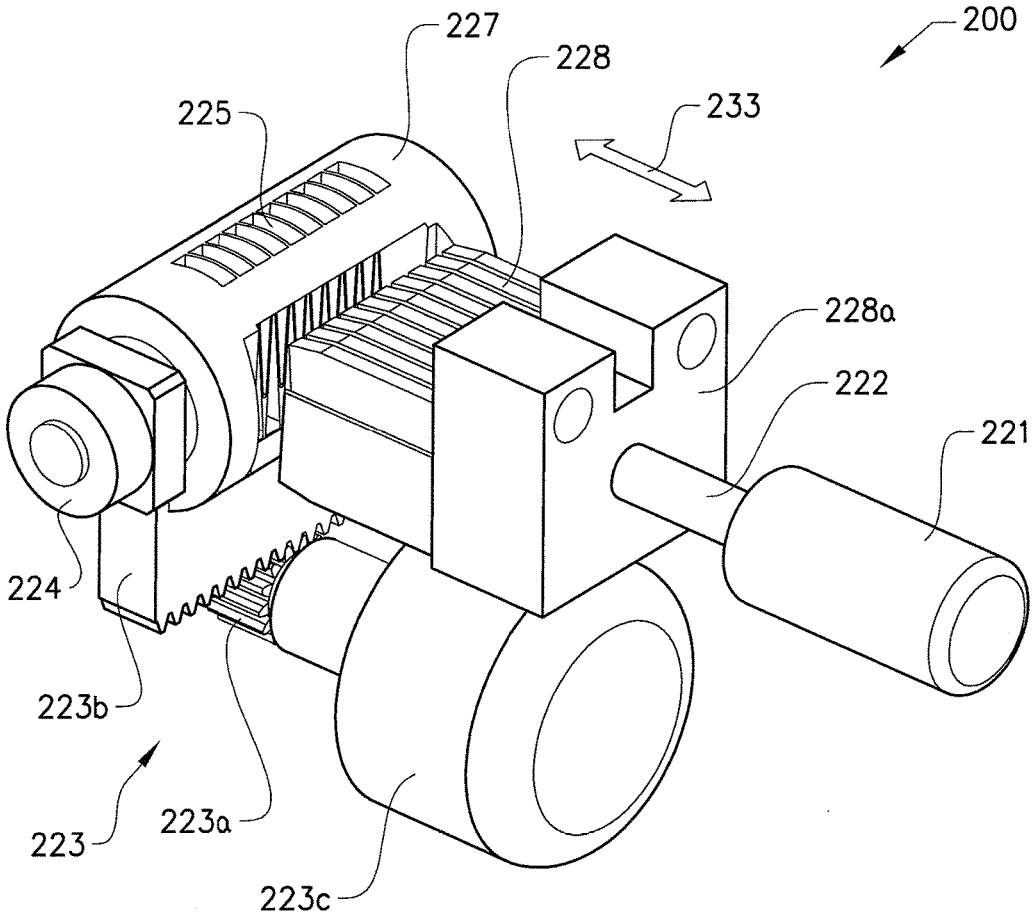
FIG. 8 shows parts of the second embodiment according to FIG. 7.
Figure 9:
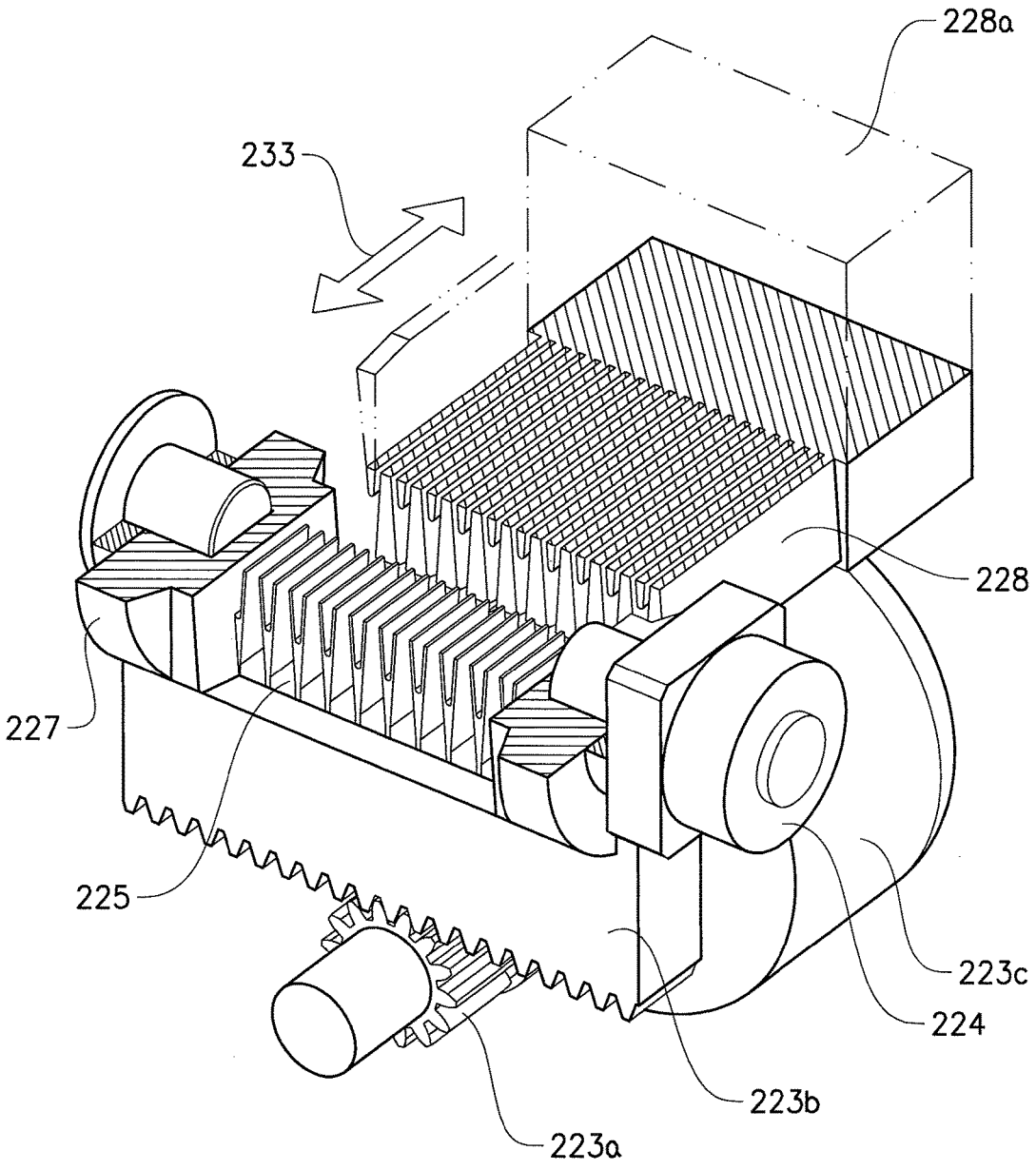
FIG. 9 shows a sectional view of some of the parts shown in FIG. 8.

The positioning unit 200 shown in FIGS. 6-9 also comprises a transversal movement controlling arrangement 223, where the term transversal relates to the direction of the portion packets 5 when transported through the transporting unit 10 and into the positioning unit 200. As shown in FIGS. 7-9 the transversal movement controlling arrangement 223 comprises a geared member 223*b* connected to the supporting structure 227 and extending along the supporting structure 227 in a direction parallel to the rows of receiving compartments 225, a gear wheel 223*a* and a controllable motor 223*c*, wherein the gear wheel 223*a* is operatively connected to both the geared member 223*b* and the motor 223*c*.

The supporting structure 227 is not only rotationally suspended but also arranged to be moveable in the direction of extension of the rows of compartments 225. By controlling the transversal movement controlling arrangement 223 it is possible to move the supporting structure 227 sideways (in relation to the transporting unit 10) in a step-by-step manner so that each of the compartments 225 in the first row of compartments becomes aligned with the product channel 12 with its entrance end 225*a* facing the outlet 14 of the product channel 12. When portion packets 5 are fed to the transporting unit 10 they can now be further fed to each of the compartments 225 in the first row. By controlling the rotation controlling member 224 it is possible to rotate the supporting structure 227 180° so that the second row of compartments 225 can be filled in the same step-wise manner.

FIG. 8 shows the positioning unit 200 in a perspective view from behind. This figure clearly shows the discharging member of the positioning unit 200, which discharging member, in similarity to the positioning unit 20 described above, comprises a cylinder 221, an ejection pin 222 and an ejection element 228. The ejection element 228 comprises a number of parts protruding from a supporting part 228*a* towards the supporting structure 227. The number of protruding parts corresponds to the number of portion packet receiving compartments 225 and each of said protruding parts has a shape corresponding to that of the corresponding compartment 225. Thus the ejection element 228 has a shape that corresponds with the pattern of the compartments 225, which in this case is rectangular (which calls for the use of a corresponding rectangular container (not shown) in contrast to the circular container described above).

FIG. 9 shows parts of the positioning unit 200 in a partly sectional perspective view from the front side. This figure shows, for instance, that the cross section of the protruding parts of the ejection element 228 corresponds to the cross section of the compartments 225.

The supporting part 228*a* of the ejection element 228 is connected to the ejection pin 222 which, in line with what is described above, in turn is connected to a piston (not shown) in the cylinder 221. The position of the piston can be controlled as described above. By controlling the piston as to move in relation to the supporting structure 227 and its compartments 225 as indicated by the arrow 233 in FIGS. 8 and 9—i.e. by activating or deactivating the discharging member, the ejection element 28 can be moved towards the supporting structure 227 such as to eject portion packets 5 present in the compartments 225 (and place them in the same pattern in a container properly positioned at the positioning unit 200) and moved away from the supporting structure 227 to allow re-filling of the portion packet receiving compartments 225. An outer side of each compartment 225, i.e. the side facing away from the ejection element 228, is open as to allow the portion packets 5 to be ejected in that direction.

The function of the positioning unit 200 shown in FIGS. 6-9 is in principal the same as for the unit 20 shown in FIGS. 1-5. A general feature is that the transporting unit 10 and the portion packet receiving compartments 25, 225 are movable in relation to each other such that the entrance end 25*a*, 225*a* of each of the compartments 25, 225 can be moved and directed towards the transporting unit 10. In the example shown in FIGS. 6-9 the compartments 225 are attached to the supporting structure 227 that is (transversely) movable in relation to the transporting unit 10. Since the supporting structure 227 also rotationally suspended in the positioning unit 200 the entrance ends 225*a* of the compartments 25 can be also be directed in different directions by rotating the supporting structure 27. This way it is possible to make use of two rows of compartments 225 having their entrance ends 225*a* facing in opposite directions. The positioning unit 200 may comprise only one row of compartments 225, which would make it possible to dispense with the rotational arrangement of the supporting structure 227 (but would lead to a rather long and narrow portion packet pattern).

FIGS. 10 and 11 show a preferred embodiment of a container holding arrangement 80 of the inventive device. This preferred container holding arrangement 80 comprises a supporting plate 81 onto which a container 7 can be placed. The supporting plate 81 is rotationally suspended to a rod 82 via side plates 83, 84. A cylinder 85 and a corresponding piston 86, that may be e.g. pneumatically driven, are arranged to provide a rotational movement of the supporting plate 81 around the rod 82. This way a container 7 placed onto the supporting plate 81 when the supporting plate 81 is in a first position can be suitably positioned at the positioning unit 20 when the supporting plate 81 is in a second position for receiving the portion packets 5 discharged by the discharging member 21, 22, 28.

In FIG. 10 the container holding arrangement 80 is in a first position in which a filled container can be removed from the supporting plate 81 and be replaced by an empty container 7. In FIG. 11 the container holding arrangement 80 is in a second position in which an empty container 7 can be filled with portion packets 5 positioned according to the pattern of the position unit 20. When the container 7 has been filled the cylinder 85 and the piston 86 are set in operation such that the supporting plate 81 is rotated back to the first position.

To allow for a high speed of production the container holding arrangement 80 must be capable of operating at a high speed. An opening 87 is arranged in the supporting plate 81 intended for connection to a vacuum (i.e. low pressure) source (not shown) for the purpose of creating a suction force below the container 7. This way the container 7 can be held in place on the supporting plate 81 even when the supporting plate 81 moves very quickly between the first and second positions.

The preferred container holding arrangement 80 has been exemplified in connection to the first embodiment of the positioning unit 20 but can be used also in connection to other positioning unit variants.

The inventive device 1, or the manufacturing arrangement, further comprises a control unit (not shown) for controlling the movements of the supporting structure 27, 227 (and its associated compartments 25, 225) and of the ejection element 28, 228. The device also comprises means for controlling e.g. the feeding arrangement 3 and the container holding arrangement 8, 80. Preferably, the system also comprises sensors for determining the position of the portion packets 5, e.g. for determining whether all the compartments 25, 225 have been filled with a portion packet 5.

The invention is not limited by the embodiments described above but can be modified in various ways within the scope of the claims. For instance, even though reference has been made herein above to smokeless tobacco or smokeless non-tobacco products, the bulk material in the portion packets may be based on, for example, powdered pharmaceutical or confectionary products suitable for placing in containers or boxes according to the present invention. Further, it is not necessary that the portion packet 5 is enclosed in a pouch or other wrapping structure, although this is often necessary to hold the packet together.

The transporting unit 10 may be provided with a plurality of product channels 12 connected to the same inlet for distributing the portion packets 5 to a plurality of positioning units 20, 200. A guiding member can be arranged to guide the portion packets 5 to the different channels. Typically, each product channel 12 is provided with a separate gas channel 15.

It is not necessary that the pattern of compartments 25 forms a full circle as shown in FIGS. 1-5. Part of a circle, such as a half or a quarter of a circle, is also possible. The pattern can also include various straight or curved rows and combinations of various rows and parts of circles.

Further, the device 1 can be designed and operated such that two or more portion packets 5 are positioned in a single receiving compartment 25, 225.

The portion packet receiving compartments 25, 225 do not necessarily have to be wedge shaped but can, for instance, comprise parallel sidewalls and a third wall arranged at the retaining end 25*b*, 225*b*. Further, this third wall may be connected to the side walls or form part of another element that may or may not be moveable in relation to the side walls. However, wedge shaped compartments are advantageous in that the portion packs can be kept in place by a clamping force. Further, all compartments of the positioning unit do not necessarily have to have the same size and shape.

The supporting structure 27, 227 can have other designs than what is described above. For instance, the material defining the compartments, i.e. walls or similar, may also form the supporting structure, or parts thereof. An important feature is that the compartments form part of a rigid structure configured to retain the shape of each compartment as well as the compartment pattern during loading and unloading of the compartments. The compartments can be attached to and/or form an integral part of such a rigid structure.

In the examples described above the dimension(s) of the container 7 used corresponds to the dimension(s) of the portions packet positioning unit 20, 200 such that the position of the portion packets 5 in relation to each other in the packet positioning unit 20, 200 is retained in the container 7. This way a complete set of portion packets hold each other in place inside the wall(s) of the container (and inside a lid that preferably is provided onto the container). The effect of retaining the relative position of the portion packets in the container may, however, be achieved by other means, such as by arranging a wall structure inside the container.

The invention claimed is:

1. A system for manufacturing portion packets of a product for oral use, said system comprising:

a forming arrangement configured to form portion packets of a bulk material, and a device for placing the portion packets into a container, wherein the device comprises a portion packet transporting unit and a portion packet positioning unit, wherein the transporting unit is configured to transport individual portion packets to the positioning unit and wherein the positioning unit is configured to position the portion packets in a certain pattern during operation of the device, wherein the transporting unit comprises a product channel for transportation of the portion packets, said product channel having an inlet and an outlet, wherein the transporting unit further comprises a gas channel configured to be connected to a source of pressurized gas, wherein the gas channel is configured to, when connected to said source, guide pressurized gas into the product channel in a direction towards the product channel outlet, and wherein the gas channel has an outlet opening positioned in the product channel at a distance from the product channel inlet configured to create an under-pressure at the product channel inlet when pressurized gas is fed through said gas channel such that a suction force sucks the portion packets into the product channel and such that the gas also further forces portion packets in the product channel towards the outlet.

2. The system according to claim 1, wherein the gas channel is configured such that, when pressurized gas is discharged from the gas channel outlet opening into the product channel, the gas exhibits an initial direction of flow that forms an angle that is less than 30° in relation to a longitudinal direction of the product channel.

3. The system according to claim 1, wherein the gas channel outlet opening is positioned at a distance from the product channel outlet and that the product channel is substantially straight between the position of the gas channel outlet opening and the product channel outlet.

4. The system according to claim 1, wherein the product channel has a width and height that is 1-15% larger than a width and thickness of the portion packet to be transported.

5. The system according to claim 1, wherein the ratio between the area of the gas channel outlet opening and the cross-sectional area of the product channel is in the interval of 0.02-0.2.

6. The system according to claim 1, wherein the positioning unit comprises a set of portion packet receiving compartments arranged in a certain pattern, each of said compartments having an entrance end allowing a portion packet to enter the compartment and, at an opposite side of the compartment, a retaining end preventing a portion packet from exiting the compartment in that direction, wherein the positioning unit further comprises a discharging member configured to discharge portion packets from the compartments to the container, wherein the compartments are associated with a supporting structure that retains the compartment pattern during operation of the device.

7. The system according to claim 6, wherein each of said compartments comprises a first and a second wall member arranged at an angle in relation to each other such as to form a wedge-shaped structure, wherein the wider end of the wedge-shaped structure forms the compartment entrance end.

8. The system according to claim 6, wherein the transporting unit and the portion packet receiving compartments are movable in relation to each other such that the entrance end of each of the compartments can be directed towards the transporting unit.

9. The system according to claim 7, wherein the compartments are arranged side-by-side such that a single wall member forms a dividing wall between two adjacent compartments.

10. The system according to claim 6, wherein the supporting structure is moveably suspended in the positioning unit such that the entrance ends of the compartments can be positioned in different directions and/or positions by moving the supporting structure.

11. The system according to claim 6, wherein the discharge member comprises an ejector element that has a shape that corresponds with the pattern of compartments such that the ejector element, when activated, is capable of ejecting portion packets present in each of the compartments.

12. The system according to claim 6, wherein the discharge member is configured to discharge portion packets from each of the compartments in a direction that is substantially perpendicular to a direction corresponding to a straight line connecting the entrance and retaining ends of the compartment.

13. The system according to claim 1, wherein it comprises a packaging arrangement configured to wrap a packaging material around individual portion packets, wherein said packaging arrangement is arranged upstream of the transporting unit so that portion packets fed to the transporting unit are wrapped in said packaging material.

14. The system according to claim 2, wherein the gas channel outlet opening is positioned at a distance also from the product channel outlet and that the product channel is substantially straight between the position of the gas channel outlet opening and the product channel outlet.

15. The system according to claim 3, wherein the product channel has a width and height that is 1-15% larger than a width and thickness of the portion packet to be transported.

16. The system according to claim 3, wherein the ratio between the area of the gas channel outlet opening and the cross-sectional area of the product channel is in the interval of 0.02-0.2.

17. The system according to claim 3, wherein the positioning unit comprises a set of portion packet receiving compartments arranged in a certain pattern, each of said compartments having an entrance end (allowing a portion packet to enter the compartment and, at an opposite side of the compartment, a retaining end preventing a portion packet from exiting the compartment in that direction, wherein the positioning unit further comprises a discharging member configured to discharge portion packets from the compartments to the container, wherein the compartments are associated with a supporting structure that retains the compartment pattern during operation of the device.

18. The system according to claim 7, wherein the transporting unit and the portion packet receiving compartments are movable in relation to each other such that the entrance end of each of the compartments can be directed towards the transporting unit.

19. The system according to claim 6, wherein the portion packet receiving compartments include walls configured to retain the shape of each compartment and the certain pattern during loading and discharging of the compartments.

20. The system according to claim 1, wherein the positioning unit comprises a set of portion packet receiving compartments arranged in a certain pattern, each of said portion packet receiving compartments having an entrance end allowing a portion packet to enter the compartment and, at an opposite side of the compartment, a retaining end preventing a portion packet from exiting the compartment in that direction, the compartments including walls configured to retain the shape of each compartment and the certain pattern during loading and unloading of the compartments.

* * * * *